US006840289B2

(12) United States Patent
Hillegonds

(10) Patent No.: US 6,840,289 B2
(45) Date of Patent: Jan. 11, 2005

(54) PNEUMATIC CABLE TIE TOOL

(75) Inventor: Lawrence A. Hillegonds, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 10/282,575

(22) Filed: Oct. 29, 2002

(65) Prior Publication Data

US 2004/0079436 A1 Apr. 29, 2004

(51) Int. Cl.[7] ..... B21F 9/02
(52) U.S. Cl. ..... 140/93.2; 140/123.6
(58) Field of Search ..... 140/93.2, 123.6

(56) References Cited

U.S. PATENT DOCUMENTS

| | | | |
|---|---|---|---|
| 3,197,829 | A | 8/1965 | Caveney et al. |
| 3,254,680 | A | 6/1966 | Caveney et al. |
| RE26,492 | E | 11/1968 | Caveney et al. |
| 3,661,187 | A | 5/1972 | Caveney et al. |
| 3,865,156 | A | 2/1975 | Moody et al. |
| 3,946,769 | A | 3/1976 | Caveney et al. |
| 3,976,108 | A | 8/1976 | Caveney et al. |
| 4,004,618 | A | 1/1977 | Turek |
| 4,047,545 | A | 9/1977 | Paradis |
| 4,119,124 | A | 10/1978 | Collier et al. |
| 4,192,358 | A | 3/1980 | Bone |
| RE30,996 | E | 7/1982 | Pobuta et al. |
| 4,498,506 | A | 2/1985 | Moody et al. |
| 4,793,385 | A | 12/1988 | Dyer et al. |
| 4,862,928 | A | 9/1989 | Caveney et al. |
| 4,934,416 | A | 6/1990 | Tonkiss |
| 4,997,011 | A | 3/1991 | Dyer et al. |
| 5,492,156 | A | 2/1996 | Dyer et al. |
| 5,595,220 | A | 1/1997 | Leban et al. |
| 5,630,450 | A | 5/1997 | Kurmis et al. |
| 5,647,407 | A | 7/1997 | Scott et al. |
| 5,769,133 | A | 6/1998 | Dyer et al. |
| 5,853,524 | A | 12/1998 | Nix |
| 5,915,425 | A | 6/1999 | Nilsson et al. |
| D430,781 | S | 9/2000 | Hillegonds |
| 6,206,053 | B1 | 3/2001 | Hillegonds |
| 6,457,492 | B1 | 10/2002 | Kuhn et al. |

FOREIGN PATENT DOCUMENTS

| | | |
|---|---|---|
| EP | 0035367 | 9/1981 |
| EP | 0042786 | 12/1983 |

OTHER PUBLICATIONS

MK7P Cable Tie Installation Tool instruction sheet, by Hellermann Tyton, a Spirent Company.

*Primary Examiner*—Lowell A. Larson
(74) *Attorney, Agent, or Firm*—Robert A. McCann; Christopher S. Clancy

(57) ABSTRACT

A tool for installing a cable tie, said cable tie having a head portion and an elongate tail portion extending therefrom, said tool comprising a housing having a distal end and a proximate end, a tensioning mechanism for tensioning said cable tie to a predetermined tension setting, said tensioning mechanism operatively supported by said housing, a cutting mechanism for severing an excess portion of said tail from said tensioned cable tie, said cutting mechanism operatively supported by said housing, a manually actuable external power delivery system for actuating said tensioning and cutting mechanisms, said power delivery system for delivering power generally in line with said tensioning mechanism, and a restraint mechanism for providing said predetermined tension setting wherein said restraint mechanism provides said predetermined tension generally in line with said tensioning mechanism and said power delivery system.

16 Claims, 11 Drawing Sheets

PNEUMATIC CABLE TIE TOOL

BACKGROUND OF THE INVENTION

The present invention relates generally to hand-held cable tie tensioning and severing tools, and more particularly, to an improved tool for reliably installing or applying high tension to flexible cable ties and severing the ends thereof without over-tensioning the cable ties.

As is well known to those skilled in the art, cables ties are typically used to bundle or secure a group of elongated articles, such as electrical wires and cables. Cable ties of conventional construction include a cable tie head and an elongated tail extending therefrom. The tail is wrapped around a bundle of articles and thereafter inserted through a passage in the head. The head of the cable tie typically supports a locking element that extends into the head passage and engages the tail to secure the tail to the head, or at least prevent rearward travel of the tail back through the passage so as to disengage the head.

In practice, the installer manually places the tie about the articles to be bundled, inserts the tail through the head passage and then manually tightens the tie about the bundle. At this point, a cable tie installation tool may be used to tension the cable tie to a predetermined tension about the bundle. With manually powered tools, one or more grip strokes may be needed to sufficiently tension the tie, depending upon, among other things, how much tension is desired. Once the strap tension approaches the desired level of tension, as predetermined and reflected in the tension setting level of the tool, the tool severs the excess tail portion from the tie, i.e., that portion of the tail which extends beyond the head of the cable tie.

With pneumatic tools, a single depression of a button or the like is typically used to activate pneumatic pressure to tension the cable tie to the predetermined tension. Similar to the manually powered tool, once the predetermined tension setting level is reached on a pneumatic tool, the tool severs the excess tail portion from the tie.

Most prior tools, though capable of tensioning and thereafter severing the excess tail portion of the cable tie, have several disadvantages associated therewith which, either singularly or plurally, increase the frequency of operator injuries, and increase the frequency and magnitude of tool degradation and failure. For example, the cast metal body tool disclosed in U.S. Pat. No. 3,661,187 to Caveney, et al., represents what is now a conventional linkage style tensioning and severing assembly. Relative to more recent designs, the tool housing shown in the '187 patent is not very ergonomic, though the linkage design is extremely durable. The cast metal body provides apertures in which pins or shafts are secured to mount and provide pivot points for the many linkage arms. Since the linkage assembly style of tensioning and severing generates such high forces at the pin locations and cantilevered loads on the linkages, the durable cast metal body becomes a necessity for reliable operation and to keep the pins from distorting the housing and deleteriously migrating. Using the stored energy principle of a partially compressed spring, accurate and predictable severance breakaway is achieved when the pins cannot move and the arms move through their intended movements. A disadvantage of the cast metal body, however, is that it requires a significant number of manufacturing steps, driving the cost higher.

Other prior art examples include U.S. Pat. Nos. 4,793,385, 4,997,011, and 5,492,156, all to Dyer, et al., which disclose an ergonomically motivated plastic bodied tool. A conventional linkage style arrangement similar to that disclosed in Caveney, et al., is used, but the tension adjustment assembly has been moved to the top of the tool. In this location, the operator can more easily see and manipulate the tension adjustment knobs. Additionally, a more deeply curved handle is shown, though in practice the foam handle cover used therewith yields a result which is not very ergonomic. The major disadvantage of this tool is the combination of a high angular force linkage design and a plastic body. Due to this combination, the tool is not nearly as durable as some previous designs. The high off-center loading forces of the linkage design are exerted on the pins mounted in the plastic body. As the number of cycles of the tool increases, the pin holes become elongated and allow the pins to migrate or wobble. Consequently, the uniform severance point that is normally achieved with the linkage style design becomes unpredictable, and accurate and consistent tensioning is not possible. Ultimately such a tool will fail to produce reasonably repeatable results, after which the tool must be discarded.

Another prior art tool is described in U.S. Pat. No. 5,915,425 to Nisson, et al. It proposes to solve several ergonomic disadvantages of prior tools by providing an adjustable grip size, a rotatable nose, and reduced recoil shock/vibration. While attempting to overcome these disadvantages, the plastic bodied tool disclosed in the '425 patent incorporates a more variable tensioning and severing assemblies than those previously disclosed. In practice, the design has resulted in a poorly performing tool that is not durable, is subject to tensioning inconsistences between tools, fails to provide a distinct and uniform severance point, is unable to accurately calibrate its tension setting, and includes a fragile tension setting device.

Yet another tool is described in U.S. Pat. No. 6,206,053 to Hillegonds. The manually activated and manually powered cable tie tensioning and severing tool described therein provides numerous advantages over prior designs and permits users to quickly and economically apply successive ties under uniform predetermined tensions, resulting in consistent cut-off heights. Additionally, the design includes a tension rod and generally aligned cutting mechanism sleeve, and a concentrically/coaxially mounted restraining means that reduces off-center loads and thereby increases the cycle life of the tool. Despite its advantages over many prior designs, however, the tool still requires manual power to tension the cable ties. Additionally, this prior design utilizes many parts and thus has a somewhat higher manufacturing cost than other designs, particularly those using external power. As the tool embodiments shown and described in U.S. Pat. No. 6,206,053 include some structures and/or assemblies that are similar or identical to specific structures and/or assemblies of the tools described herein, the entire disclosure of the '053 patent is incorporated herein by reference.

There is therefore a need in the art for a cable tie installation tool which is ergonomic, reliable, durable, consistent, lightweight, cost-efficient and externally powered.

SUMMARY OF THE INVENTION

To address the above-described need, there is provided, described, and claimed herein a cable tie installation tool that is not human-powered and includes in-line power delivery from a source external to the tool.

In one embodiment of the invention, there is provided a tool for installing a cable tie, the cable tie having a head portion and an elongate tail portion extending therefrom. The tool includes a housing having a distal end and a proximate end, a tensioning mechanism for tensioning the cable tie to a predetermined tension setting, the tensioning mechanism operatively supported by the housing, a cutting mechanism for severing an excess portion of the tail from the tensioned cable tie, the cutting mechanism operatively supported by the housing, an external power delivery system for actuating the tensioning and cutting mechanisms, the power delivery system for delivering power generally in line with the tensioning mechanism, and a restraint mechanism for providing the predetermined tension setting wherein the restraint mechanism provides the predetermined tension generally in line with the tensioning mechanism.

In another embodiment of the invention, there is provided a tool for installing a cable tie, the cable tie having a head portion and an elongate tail portion extending therefrom. The tool includes a housing, a tensioning mechanism for tensioning the cable tie to a predetermined tension setting, the tensioning mechanism operatively supported by the housing, the tensioning mechanism including a linearly reciprocating tension rod and a reverse single acting cylinder, a cutting mechanism for severing an excess portion of the tail from the tensioned cable tie, the cutting mechanism operatively supported by the housing, a restraining mechanism including a ball detent assembly, the restraining mechanism being in communication with the reverse single acting cylinder and being generally axially aligned with the linearly reciprocating tension rod and the reverse single acting cylinder, the restraining mechanism for effecting a predetermined tension setting on the reverse single acting cylinder, and a manually actuable external power delivery system for actuating the tensioning and cutting mechanisms, the power delivery system including a pneumatic power source, a trigger, and a three-way pneumatic valve, whereby when the trigger is manually actuated, pneumatic pressure forces the reverse single acting cylinder to rearwardly pull the linearly reciprocating tension rod, thereby simultaneously restraining movement of the cutting mechanism and tensioning the cable tie until the predetermined tension setting effected by the restraining mechanism is reached in the cable tie, after which the reverse single acting cylinder is released from the pneumatic pressure such that the reverse single acting cylinder is thrust forwardly to activate the cutting mechanism such that it severs the cable tie.

DETAILED DESCRIPTION OF PREFERRED EMBODIMENTS

Figure 1:
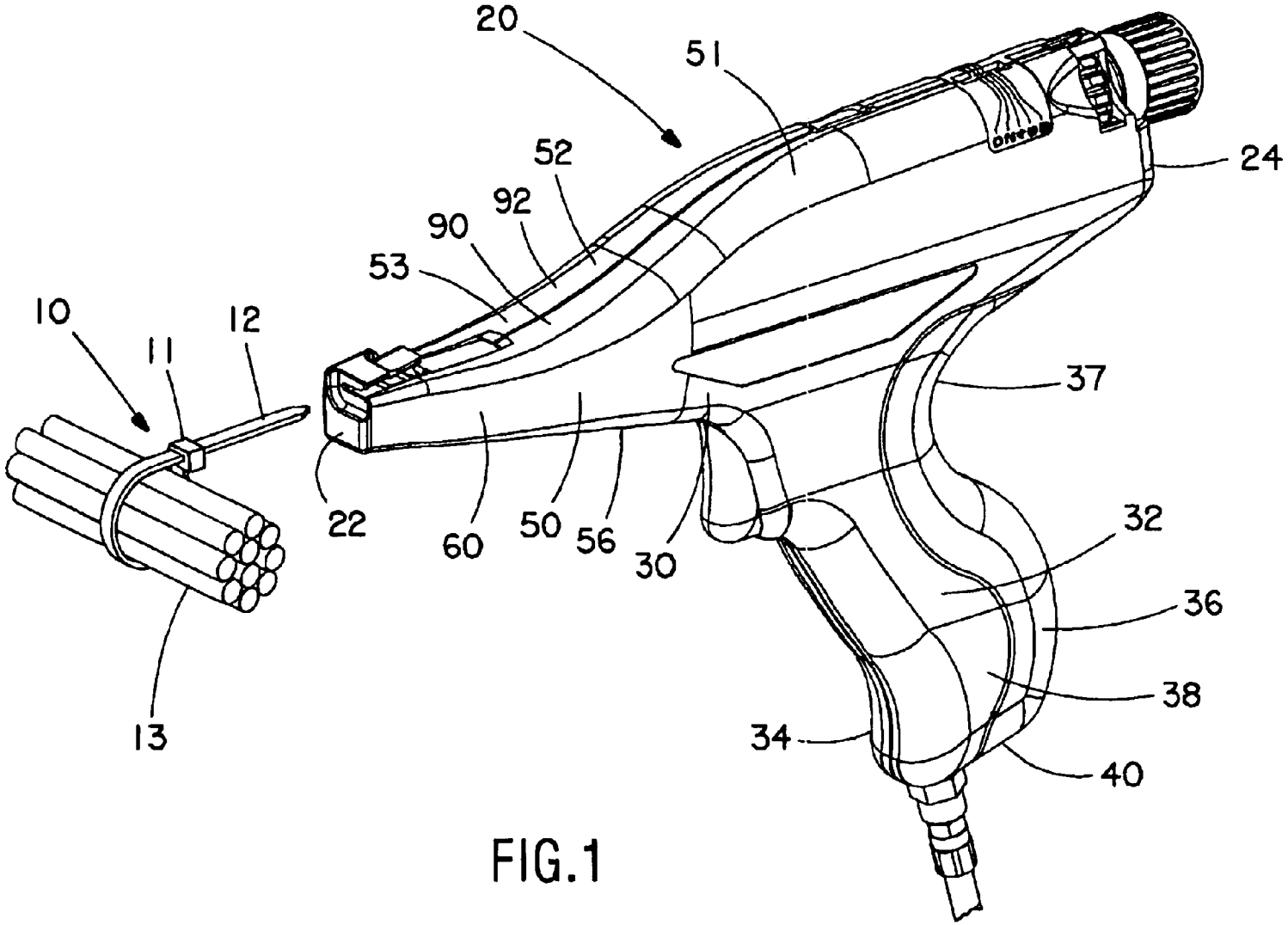
FIG. 1 is a left side front upper perspective view of a tool embodying the present invention.
Figure 2:
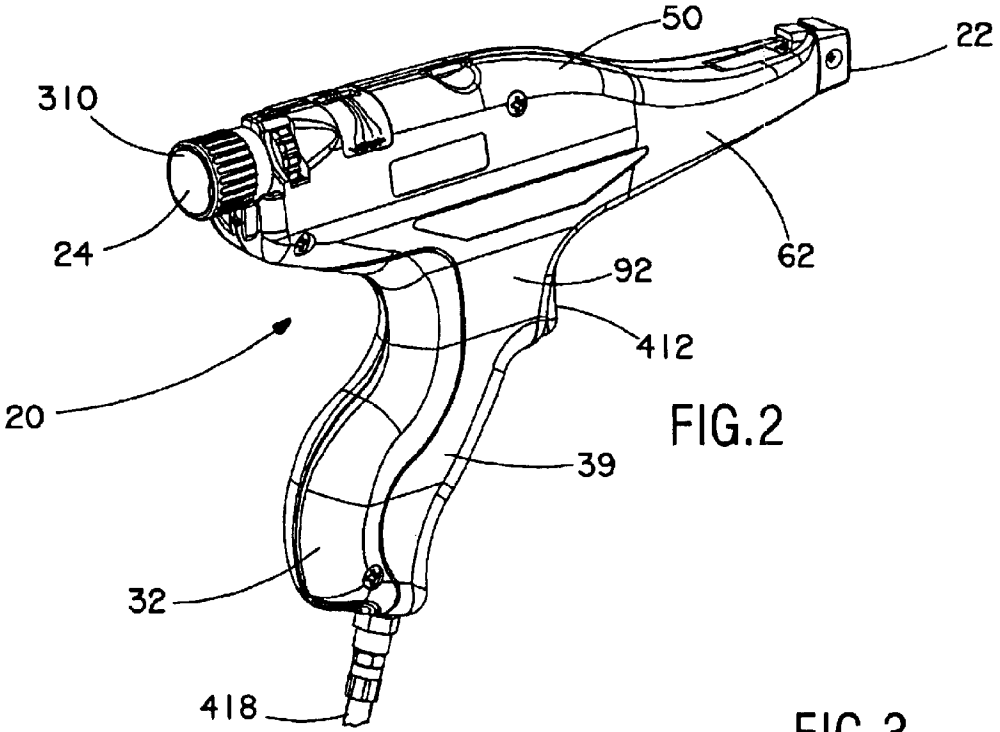
FIG. 2 is a right side upper rear perspective view of the tool of FIG. 1.
Figure 3:
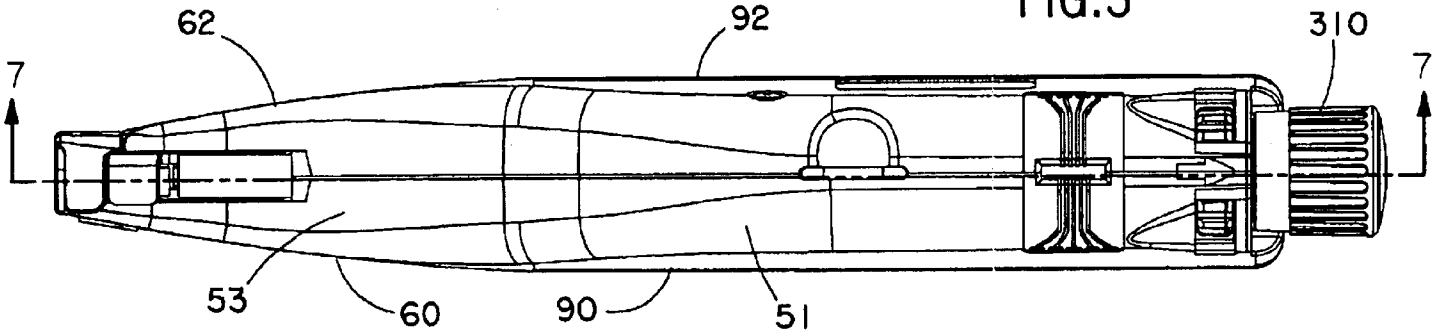
FIG. 3 is a top plan view of the tool of FIG. 1.

A tool for installing a cable tie embodying the present invention is designated generally by the reference numeral 20 in the accompanying drawings. As shown in FIGS. 1–3, the hand-held tool 20 has a housing 30 having a handle portion 32 and a barrel portion 50. The housing 30 includes two separate complimentary sidewall portions 90 (left) and 92 (right) that are secured together to define the handle portion 32 and the barrel portion 50. The handle portion 32 has a front 34, a back 36, opposite sides 38 and 39, and a bottom 40. In the illustrated embodiment, the sides 38 (left) and 39 (right) are generally arcuately shaped for ergonomic reasons and are substantially mirror images of one another. The back 36 is also correspondingly arcuately-shaped, including a deeply recessed portion 37 which enhances the ergonomics of the tool 20. The front 34 is also arcuately-shaped, however, less dramatically so than the back 36. The bottom 40 has a curvilinear surface joining the sides 38 and 39, and the front 34 and back 36 together at a common point on the lower extension of the handle.

Figure 4:
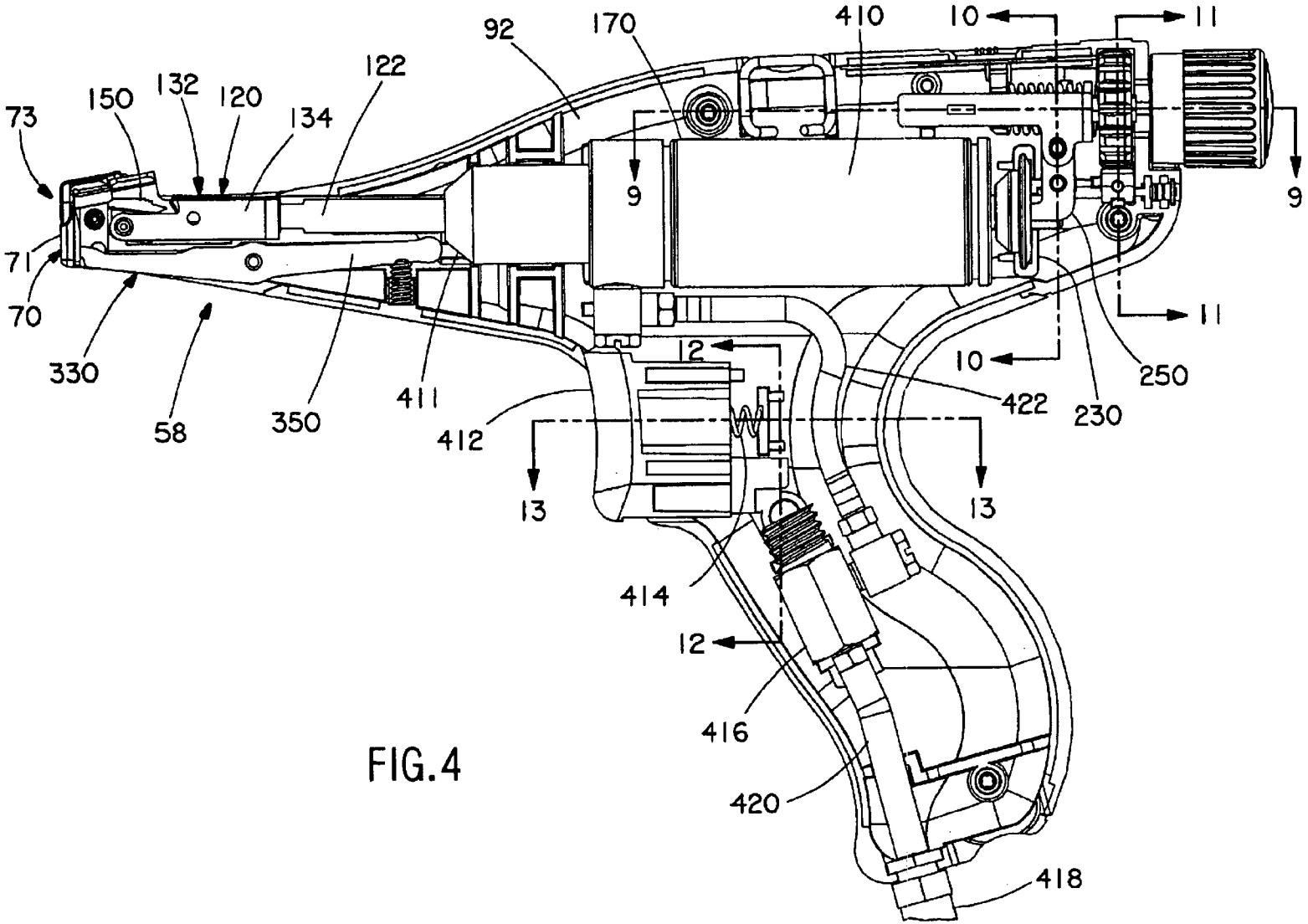
FIG. 4 is a side elevation view of the tool of FIG. 1 with the left hand side body housing removed to permit interior parts to be viewed.
Figure 5:
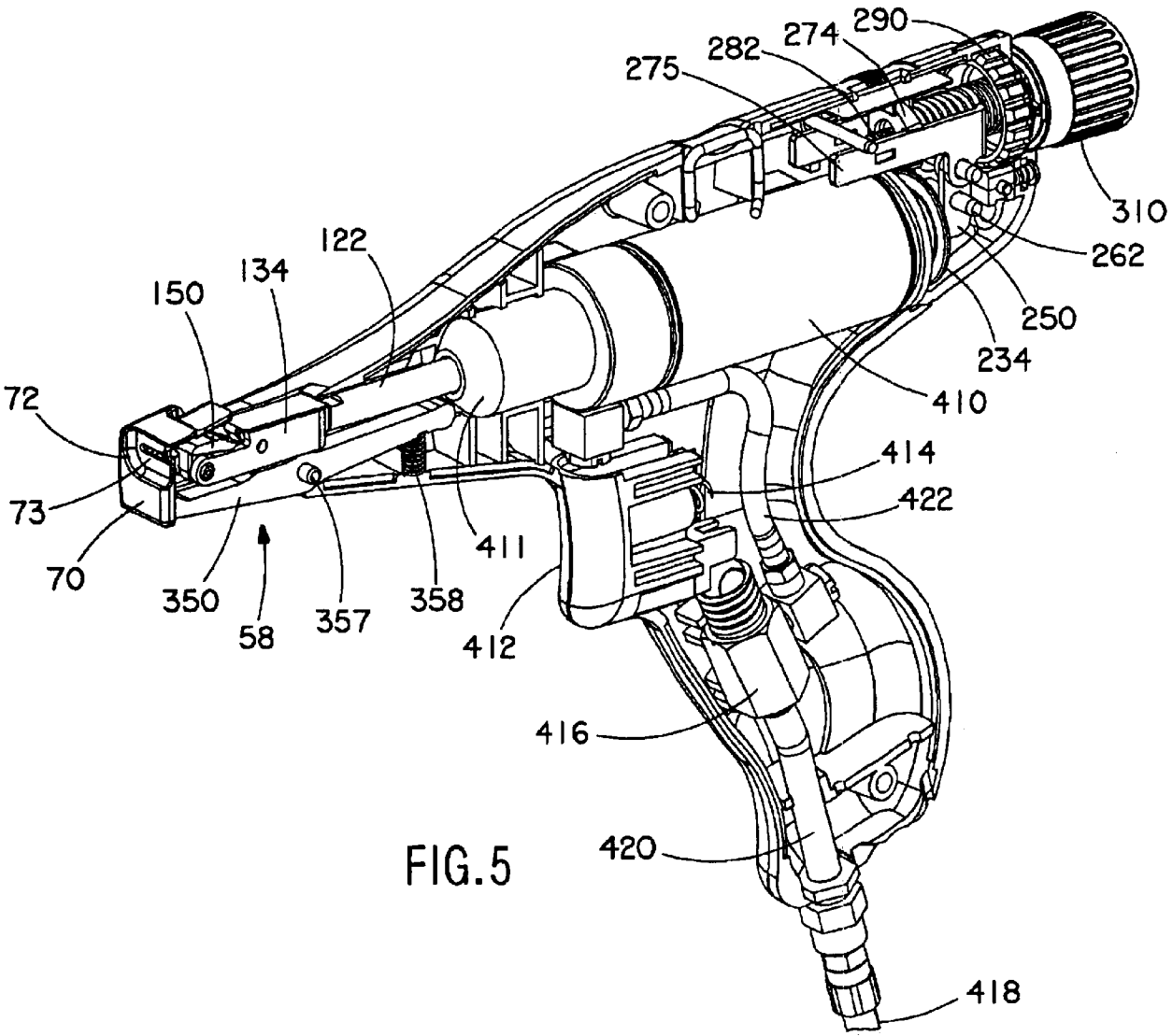
FIG. 5 is a left side front upper perspective view of the tool of FIG. 1 with the left hand side body housing removed to permit interior parts to be viewed.

The barrel portion 50 has a top 52, a bottom 56, and opposite sides 60 (left) and 62 (right). In the illustrated embodiment, the top 52 is generally characterized as having a rounder portion 51 nearer the handle portion 32 and a more planar top portion 53 formed near the distal end 22 of the tool. The bottom 56 is substantially planar in configuration and is generally parallel to the planar top portion 53. As seen in FIGS. 4 and 5, a substantially rectangular aperture 58 is provided in the bottom 56 in order to accommodate the cutting mechanism.

In FIGS. 4–7, one side wall 90 of housing 30 has been cut away or removed to show the other housing sidewall 92 interior and the internal parts and assemblies. The housing 30 generally contains a reciprocating tensioning mechanism 120, formed by a preferably cylindrically shaped tension rod 122 and a gripper assembly 132 disposed at the distal end of the tension rod 122 for gripping the tie tail 12 of cable tie 10. The tension rod 122 extends generally parallel to the planar portion 53 of the top 52 of the barrel portion 50. The tensioning mechanism 120 is operatively associated with an actuating mechanism 170 and is also operatively connected to a restraining mechanism 230, and to a tie cutting mechanism 330.

The tool 10 includes a blade guard 70 at the distal end 22 of the tool. In a preferred embodiment, the blade guard 70 is made of metal. The blade guard 70 is preferably manufactured by a metal injection process for providing strength at a lower cost. The blade guard 70 preferably includes a forward planar surface 71 facing away from the tool barrel 50. Formed thereon is an arcuately-shaped recessed element 72 for receiving a variety of differently sized cable tie heads of various different curvilinear shapes. The blade guard 70 also includes a tie slot 73 through the forward planar surface 71, through which the tool operator passes a cable tie tail 12 after the tail has been first wrapped around a bundle of wires 13 and threaded through a passage in the cable tie head 11.

The gripper assembly 132 is preferably identical or nearly identical in structure and function to the gripper assembly described in the '053 patent, greater detail of a preferred embodiment being shown therein. The gripper housing 134 is secured to the distal end of the tension rod 122 by a nut which engages a set of threads disposed at the distal end of the tension rod 122 after the tension rod has been inserted through an aperture in the end plate thereof. Prior to the nut being secured to the distal end of the tension rod 122, a cover, having an aperture disposed on the end panel thereof, is mounted over the distal end of the tension rod 122. The tie tail 12 is engaged by the pawl 150, which has a plurality of tie tail gripping teeth. The pawl extends out of the gripper housing 134 through a generally rectangular aperture disposed below a cable tie pressure plate. The aperture extends between the distal end of the cover and the distal end of the gripper housing. The gripping teeth are spaced apart and angled upwardly from the pawl, and have a depth and sharpness sufficient to enable the gripper to grasp either a flat or serrated cable tie tail. The pawl 150 is biased for forward rotation toward the distal end 22 of the tool 20 about a shaft by a gripper spring 136 which engages the shaft and the pawl. The pawl applies the grasping pressure on the cable tie tail 12 being held in the tie passageway between the tie pressure plate and the pawl.

Figure 7:
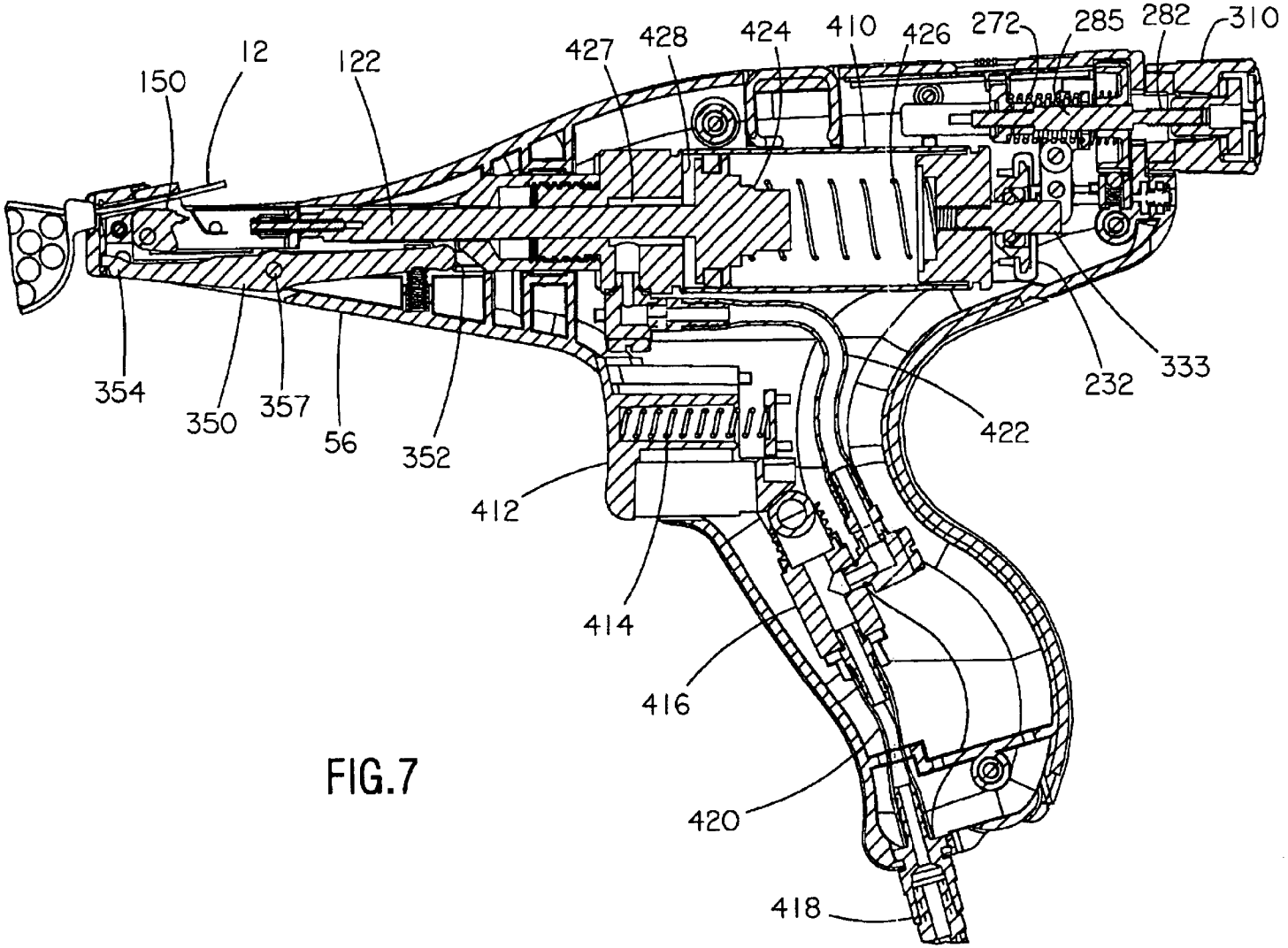
FIG. 7 is a fragmentary cross-sectional view taken through the tool substantially along the line 7—7 in FIG. 3, wherein the tool is shown prior to tensioning the cable tie.
Figure 8:
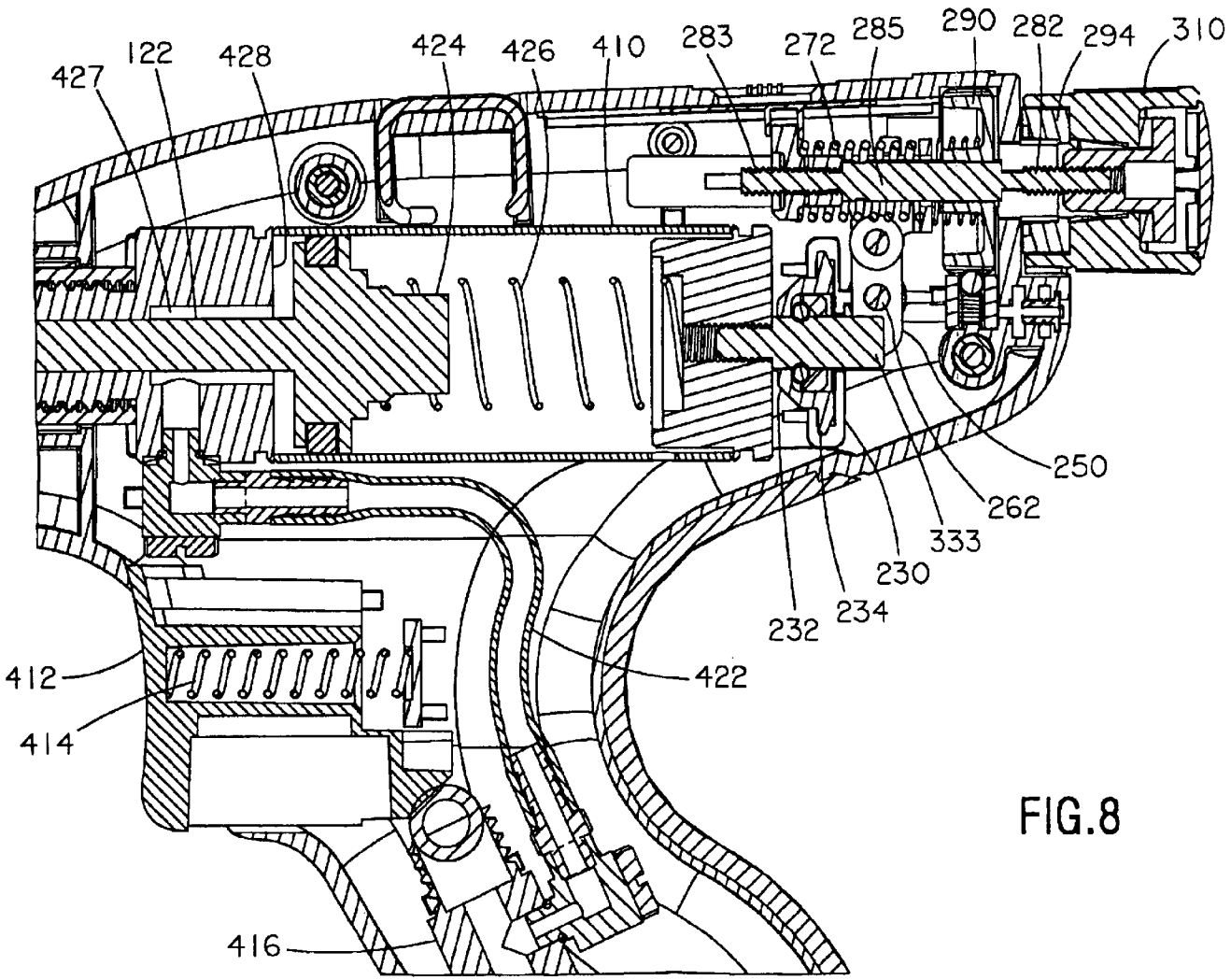
FIG. 8 is an enlarged view of a portion of FIG. 7.

With particular reference to FIGS. 7 and 8, the actuating mechanism 170 includes a piston-like reverse single acting cylinder 410. After threading a cable tie tail 12 through the tie slot 73 such that it is disposed within the gripper assembly, the user, preferably holding the tool like a pistol, uses his finger to depress the trigger 412 against the resistance of an internal spring 414 to activate a three-way pneumatic valve 416 to permit pneumatic pressure to be transmitted from an external pneumatic power supply 418 and pneumatic inlet tube 420 into the pneumatic outlet tube 422 and ultimately into the reverse single acting cylinder 410. The application of pneumatic pressure to its distal side pushes the piston 424 and the attached tension rod 122 toward the proximate end 24 of the tool 20, thereby drawing the gripped tie tail 12 back toward the proximate end and simultaneously tensioning the cable tie 10 around the bundle of wires 13.

When the tool 20 is in its initial position (FIG. 7), the tensioning mechanism 120 is biased into its forwardmost extent within the tool barrel 50 by a return spring 426 located in the reverse single acting cylinder 410. In this position, the piston 424 is just short of abutting wall 428 due to pre-load bias in the system. As pneumatic pressure fills the annular space 427 within the reverse single acting cylinder 410 on the distal side of the piston 424 and surrounded by wall 428 and the small space between wall 428 and the piston, the piston is forced proximately against the bias of a restraining mechanism 230, which is set to a predetermined tension level, as discussed in further detail below. When the reverse single acting cylinder, via the proximate piston thrust, exerts a force on the restraining means just beyond the predetermined tension setting, the reverse single acting cylinder 410 is rapidly thrust forwardly (distally). When the reverse single acting cylinder 410 is thrust forwardly, the cam 411 on the distal end thereof activates the cutting mechanism 330, and the cable tie tail is severed by the cutting mechanism in the same manner as is discussed in the '053 patent.

The restraining mechanism 230, as shown in FIGS. 8–11 and other figures, includes a ball detent assembly 232 and a tension adjustment assembly 270. Identically to the embodiment shown in the '053 patent, the ball detent assembly is generally comprised of a housing which is substantially cup-shaped and has a flange portion which radially extends from the cup-shaped bottom thereof and preferably has an annular configuration. An aperture is formed in the bottom of the cup which is generally appropriately configured to accept only a proximate surface of the detent sleeve 333 therethrough, but retain other elements of the assembly. The flange portion is positively secured to each housing sidewall 90 and 92 when inserted into a complimentary-shaped semi-circular slot formed in each housing sidewall which circumferentially retains the annularly-shaped flange portion to prevent any longitudinal movement thereof. Preferably, rotational movement is also controlled, though this is not critical. Disposed within the housing of the ball detent assembly are a number of ball bearings that are captured between the bottom of the housing and the seat for securing the sleeve in position during tensioning of the tie tail 12 until the level of predetermined tension setting in the tension adjustment assembly 270 is attained. A detailed description of this operation is provided below.

The seat has a preferably planar, annularly-shaped proximate face. An aperture is disposed therethrough and extends distally through the seat with an increasing diameter so that, at its final distal extent, it nearly equals the outside diameter of the seat. The rate of diameter increase may change the force which is imparted to the sleeve relative to the force stored in the tension adjustment assembly 270. Consequently, a circumferential restraining force is created when an angled or conical face of the seat contacts the ball bearings to impart the stored force to the sleeve.

In a preferred embodiment of the invention, the restraint mechanism 230, which may or may not be a ball detent assembly such as the one previously described, is axially aligned with the tensioning mechanism, and even more preferably also with the power delivery system, to minimize the number and degree of off-center loads in the tool, and to thereby increase the life of the tool and provide greater ease of use to the tool operator.

Figure 9:
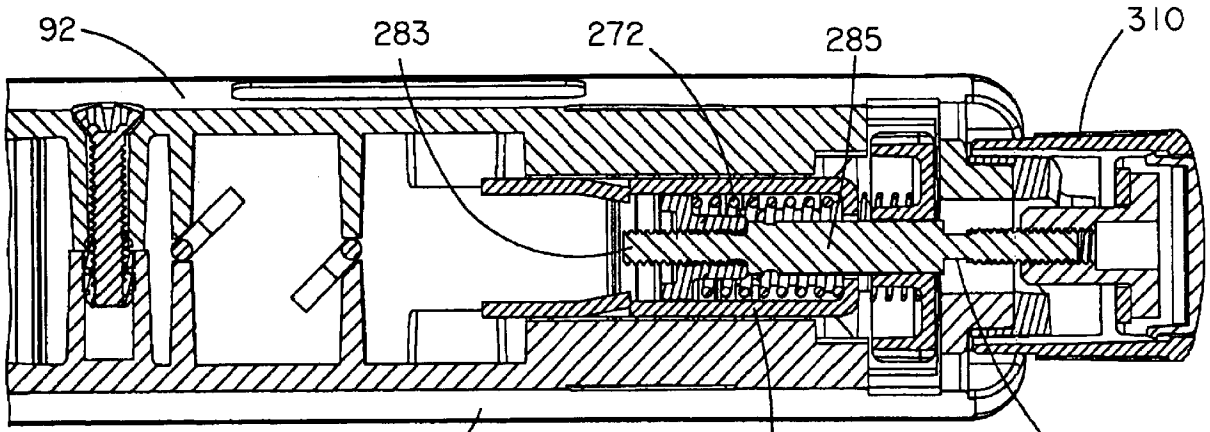
FIG. 9 is a fragmentary cross-sectional view of the tool of FIG. 1 taken substantially along the line 9—9 in FIG. 4.
Figure 11:
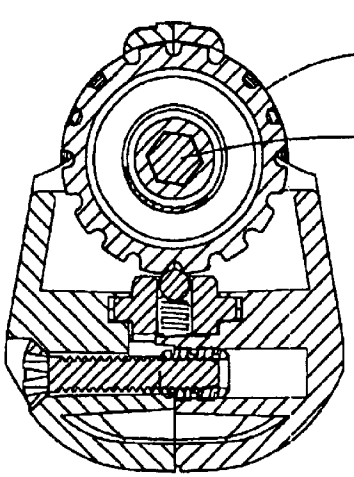
FIG. 11 is a fragmentary cross-sectional view of the tool of FIG. 1 taken substantially along the line 11—11 in FIG. 4.
Figure 10:
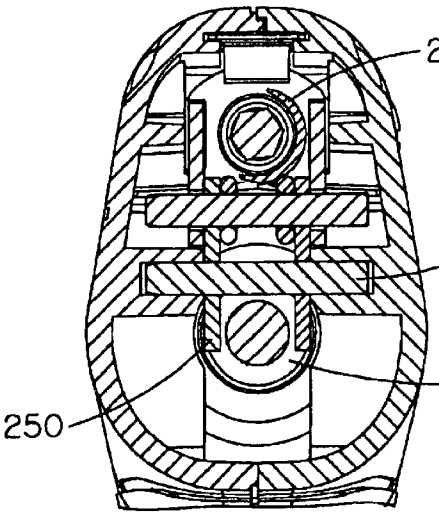
FIG. 10 is a fragmentary cross-sectional view of the tool of FIG. 1 taken substantially along the line 10—10 in FIG. 4.
Figure 14:
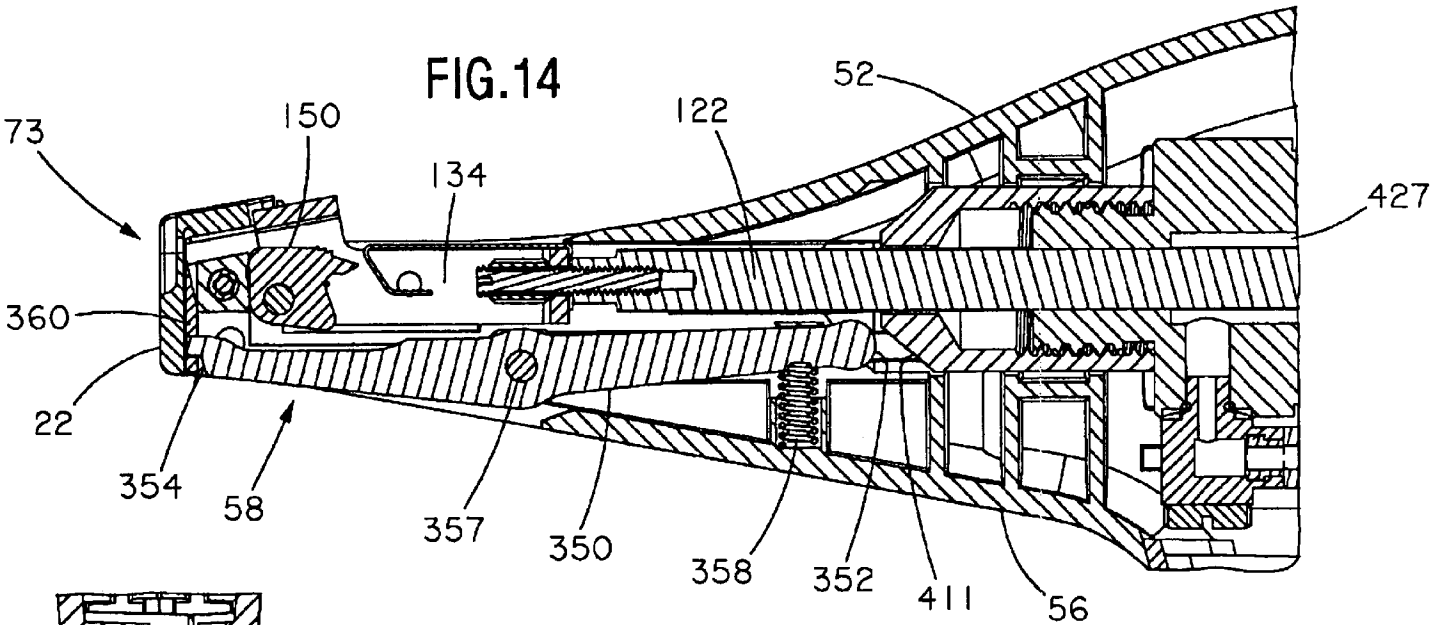
FIG. 14 is a fragmentary cross-sectional view of the tool of FIG. 1 wherein the cable tie has not yet been engaged by the tool.
Figure 13:
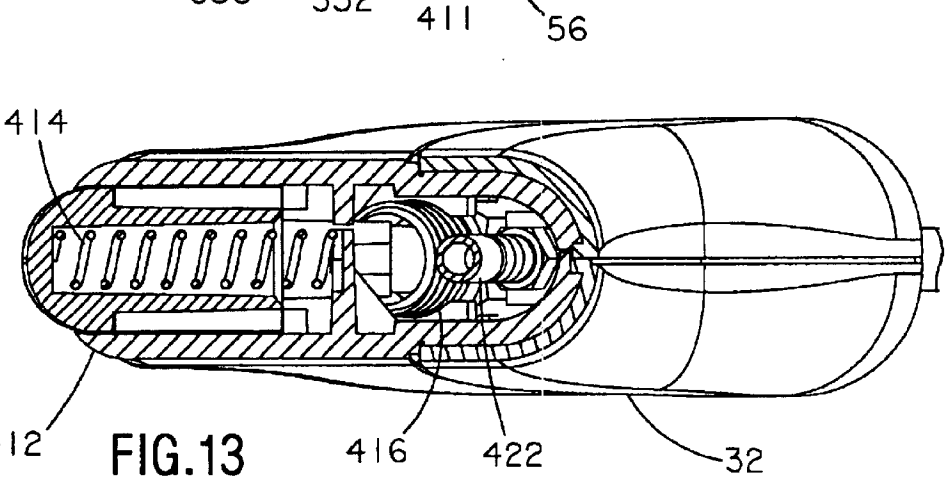
FIG. 13 is a fragmentary cross-sectional view of the tool of FIG. 1 taken substantially along the line 13—13 in FIG. 4.
Figure 12:
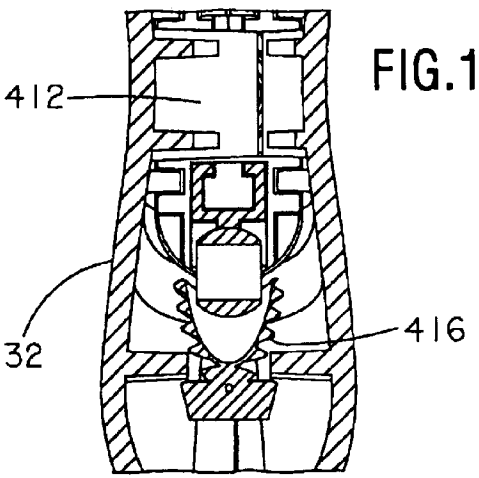
FIG. 12 is a fragmentary cross-sectional view of the tool of FIG. 1 taken substantially along the line 12—12 in FIG. 4.
Figure 15:
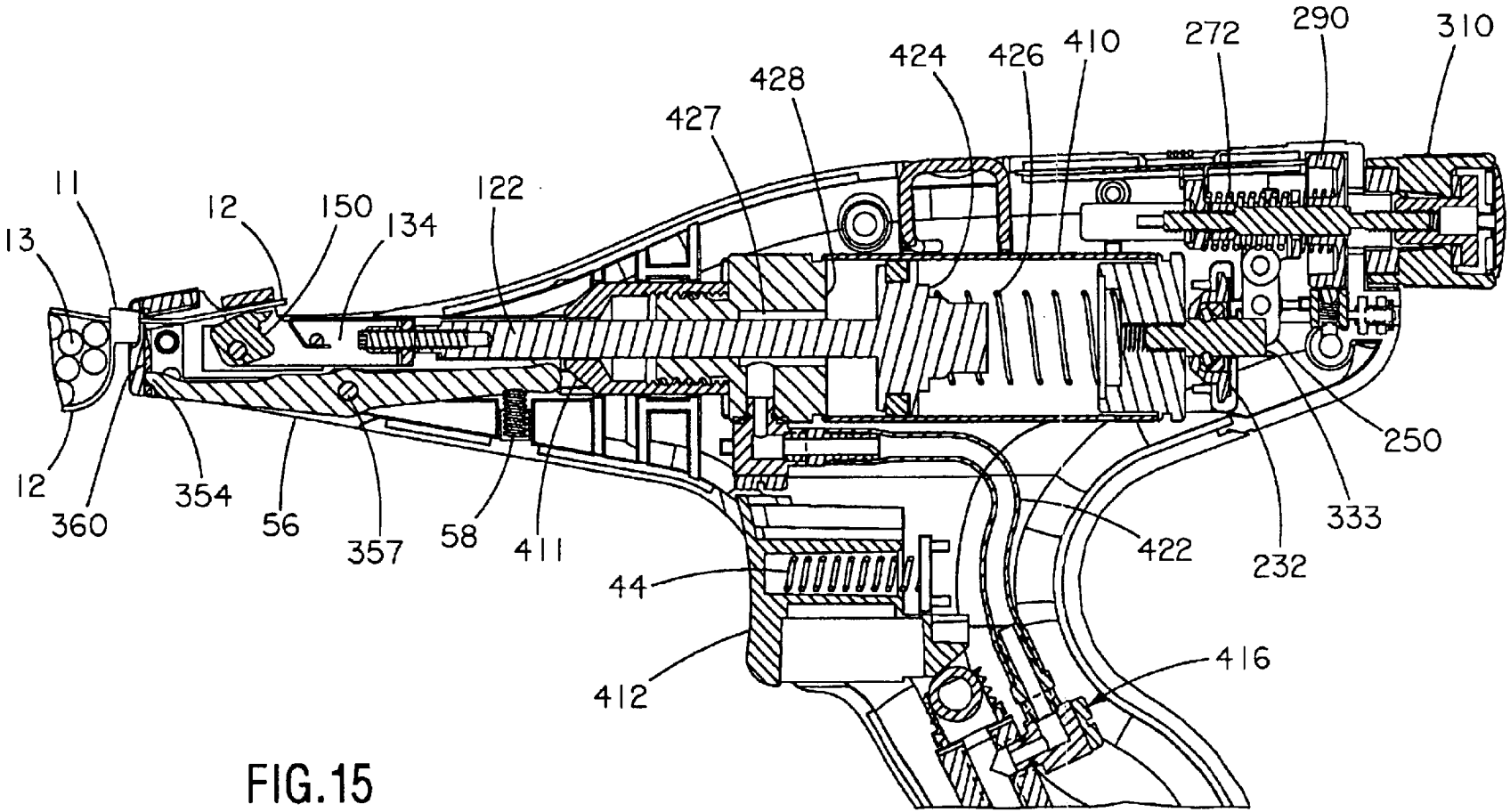
FIG. 15 is a view akin to that of FIG. 7 wherein the tool is in an intermediate stage of tensioning the cable tie.
Figure 16:
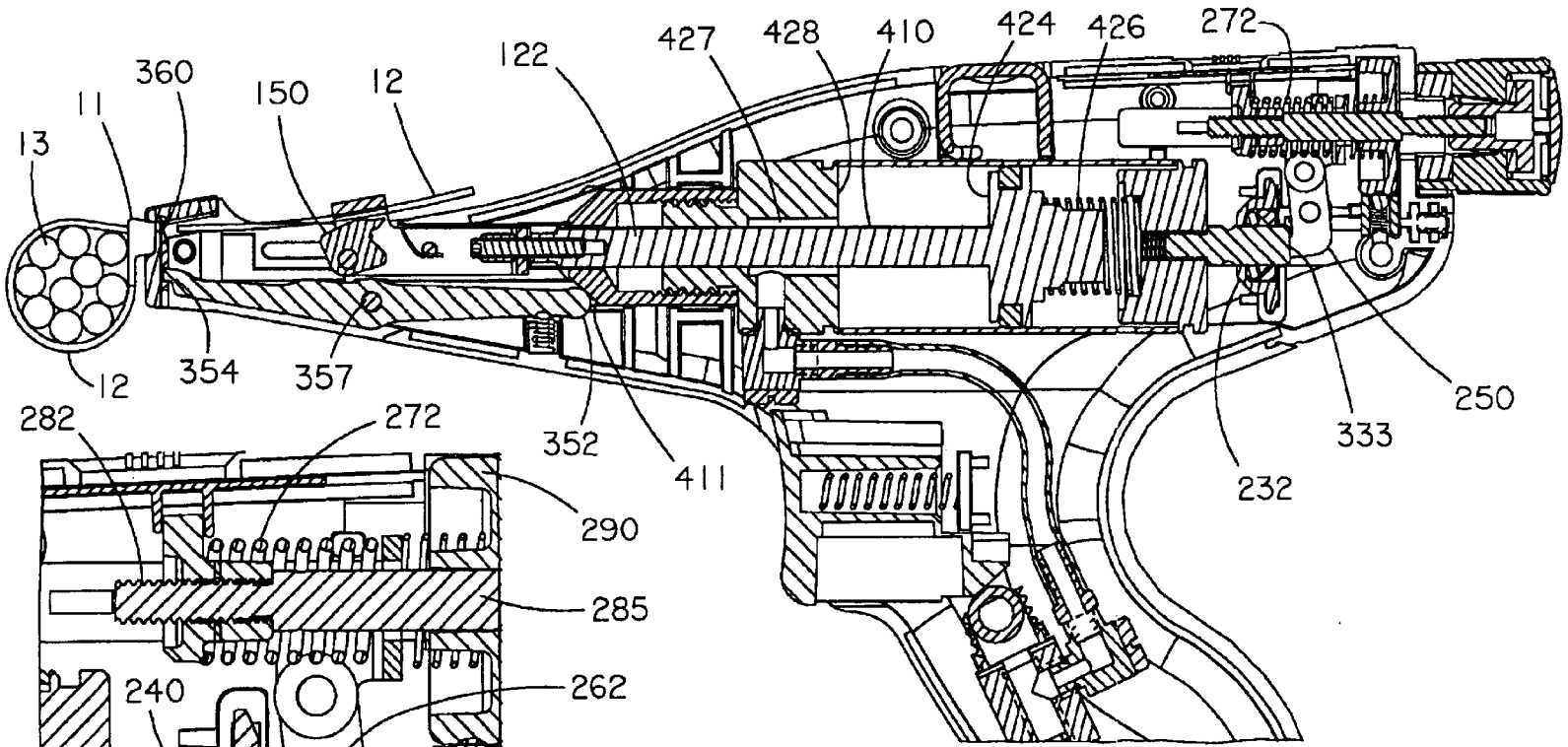
FIG. 16 is a view akin to that of FIG. 7 wherein the tool has fully tensioned and cut the cable tie.
Figure 17:
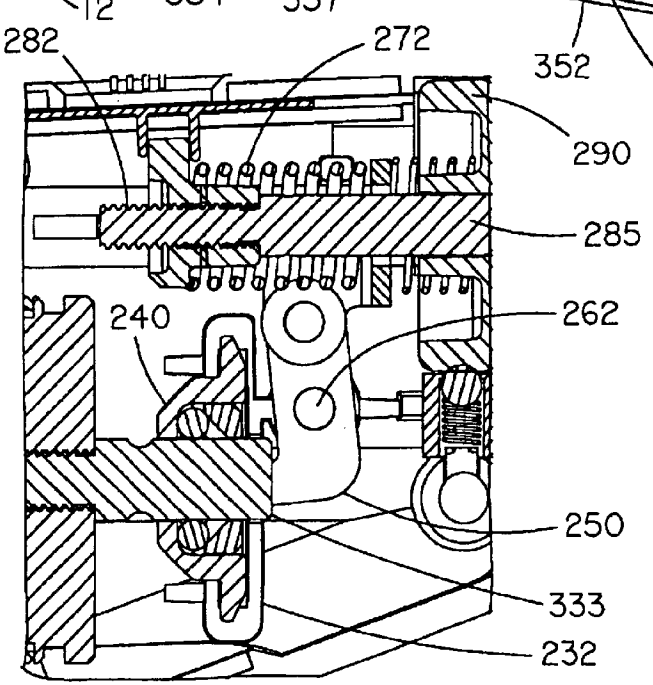
FIG. 17 is an enlarged view of a portion of FIG. 16.

As seen in FIGS. 8, 9, and 17, The tension adjustment assembly 270 is operatively connected to the ball detent assembly 232 by force transfer assembly 250, which includes a pair of reversing links pivotally mounted between the ball detent assembly 232 and tension adjustment assembly 270. At a desired position a pivot pin 262 is disposed in apertures formed substantially in the central region of each link. The pivot pin is disposed in mounting bosses of tool housing sidewalls 90 and 92. Thus, the reversing links are positively mounted, but free to pivotally rotate. One who is skilled in the art will recognize the balanced load carried by the pivot pin, resulting in less off center or cantilevered load transfer to the sidewalls 90 and 92.

Another shaft disposed in two apertures at the upper end of each reversing link operatively connects the force transfer assembly 250 to the tension adjustment assembly 270. Guide projections are disposed on each housing sidewall 90 and 92 along the travel path of the shaft in order to maintain proper alignment of the reversing links and prevent rotation of the tension adjustment assembly 270. Preferably, a light application of grease is applied to each guide projection to ensure smooth tool operation.

FIGS. 8 and 9 show a preferred embodiment of the selective tension adjustment assembly 270 which includes a tension spring 272 held between two arms 275 of the yoke 274. The spring 272 encircles a tension shaft 282 axially disposed within the yoke arms 275. The tension shaft has a threaded portion at its distal end which threadedly engages a threaded tension nut. The tension nut has opposite slots formed on the lateral edges thereof which capture and ride along the yoke arms, and which prevent rotation of the tension nut relative to the yoke arms 275. In the initial tool position (FIG. 7), the tension spring 272 is subjected to a slight preload or compression due to its placement between the tension nut and the yoke end plate. It will be seen that any rearward movement of the tension nut on the tension shaft 282 will increase the tension on the spring 272, and increase the reactive force that the spring 272 exerts upon force transfer assembly 250, and ultimately the cutting mechanism 330 via the ball detent assembly 232, and reverse single acting cylinder 410.

Preferably, substantially disposed in the generally central portion of the tension shaft 282 is a hexagonally-shaped section 285. As is obvious to those of ordinary skill in the art, this section 285 of the tension shaft 282 may have any number of flat portions as desired. Mounted on section 285 is a fine adjustment knob 290 having a generally circular outer diameter configuration and an aperture extending therethrough disposed about its center and shaped complimentary to the hexagonal section 285. Preferably, a cam 294 is provided which is generally cylindrical in shape having a variety of pairs of cam surfaces disposed at different desired heights defining the top or proximate end of the cam. These various pairs of cam surfaces enable coarse tension adjustment of the tool 20 when used in cooperation with the coarse tension adjustment knob 310.

The cam 294 preferably further includes at least one projection extending a desired distance radially inward and at least one slot extending radially outward into a wall of the cam disposed adjacent the distal end thereof, the projection and slot extending radially outward into a wall of the cam disposed adjacent the distal end thereof. The projection and slot preferably engage a complimentary slot and projection, respectively, on the tool housing to positively secure the cam in position and prevent any rotation or movement thereof, as explained in greater detail in the '053 patent. The tension shaft 282 also has a threaded portion at its proximate end which threadedly engages a threaded calibration nut for positively securing the coarse tension adjustment knob 310 to the tool and permitting the operator to establish a baseline tension setting, thereby accommodating various production tolerances. A washer is preferably provided, disposed between the head of the calibration nut and a generally segmented disk-shaped flange disposed interiorly of the proximate end of the coarse tension adjustment knob 310. Preferably, a cam follower extends from each segmented disk flange portion, which cooperate with the various pairs of cam surfaces to provide desired tension settings. A cover is preferably provided to enclose the proximate end of the coarse tension adjustment knob 310 to prevent dirt and other contaminants from reaching the calibration nut and other internal parts and mechanisms.

Compression of the tension spring 272 is selectively increased by the operator rotating the coarse tension adjustment knob 310 which consequently rotates the cam followers. In the low tension setting, the cam followers engage a first or low tension cam surface pair to establish a preselected compression or preload of the tension spring 272. When the cam followers engage the first cam surface pair, the distance between the tension nut proximate face and the yoke endplate is substantially at a maximum and thus the compression exerted on the tension spring 272 is at a minimum setting. Because the cam 294 is positively secured to the housing, when the coarse tension adjustment knob 310 is rotated from the low tension setting position to the medium tension position, the tension nut is drawn proximately toward the yoke endplate (which is fixed in its location) a distance corresponding to the difference in height of the first pair of cam surfaces relative to the second pair of cam surfaces. As is obvious to one having ordinary skill in the art, the coarse tension adjustment knob 310 does not rotate the tension shaft 282 in order to move the tension nut. Rather the coarse knob 310 pulls the tension shaft 282 and nut toward the yoke endplate. Turning the coarse tension adjustment knob 310 to the medium tension setting brings the cam followers into engagement with the second pair or medium tension cam surfaces which increases the compression on the tension spring 272 (and decreases the distance between the tension nut and yoke endplate) by an amount equal to the difference in heights of the first and second cam pair surfaces. As one of skill in the art will recognize, similar and further rotation of the coarse tension adjustment knob 310 to the high tension setting results in engagement of the third cam pair surfaces by the cam followers, further increasing the compression of the tension spring 272 and further decreasing the distance between the tension nut and yoke endplate. Increasing the compression in the tension spring 272 in this manner increases the circumferential restraining force applied to the ball detent assembly 232 via the force transfer assembly 250 and ultimately the tension in the tie tail 12.

The fine tension adjustment knob 290 is provided so that the operator has a means for finely adjusting or "fine tuning" the tension values chosen by rotation of the coarse tension adjustment knob 310. As discussed above, the fine tension adjustment knob 290 includes an aperture extending axially therethrough which has a shape that is complimentary to the central portion 285 of the tension shaft 282, preferably hexagonal as in this preferred embodiment. Consequently, the fine tension knob 290 is fixedly attached to the tension shaft central portion 285 so that the shaft 282 and fine tension knob 290 are co-rotatable. Thus, rotation of the tension shaft 282 moves the helically threaded tension nut a slight distance proximally or distally on the distal threaded shaft portion, depending on the direction of rotation of the fine tension knob 290. The tension shaft 282 extends axially through coaxial bore opening and in the cam 294 and coarse tension adjustment knob 310, respectively, such that when the shaft 282 is rotated by turning the fine tension adjustment knob 290, the shaft 282 does not rotatably engage the coarse tension adjustment knob 310 or cam 294. The proximate threaded portion of the tension shaft 282 merely threads in or out of the detent nut freely, without rotating the coarse tension adjustment knob 310. The distal end of the tension shaft 282 is threaded for a distance limited by a stop. The stop limits the extent of travel of the tension nut on the distal end of the tension shaft 282, and correspondingly limits the amount of fine tension adjustment in the compression of the tension spring 272. By turning the fine tension adjustment knob 290, the operator can slightly increase or decrease the spring length between the tension nut and the yoke endplate.

As discussed above, in a preferred embodiment, the inventive cable tie installation tool is pneumatically powered, and the actuating mechanism 170 includes a piston-like reverse single acting cylinder 410. Depression of the trigger 412 activates the three-way pneumatic valve 416 to permit pneumatic pressure to be transmitted from an external pneumatic power supply 418 ultimately into the reverse single acting cylinder 410. The application of pneumatic pressure pushes a piston 424 disposed within the cylinder 410 toward the proximate end of the tool. The tension rod 122, being integrally or otherwise attached to the piston 424, moves with the piston to activate the gripper assembly 132 and tension the tie.

Figure 6:
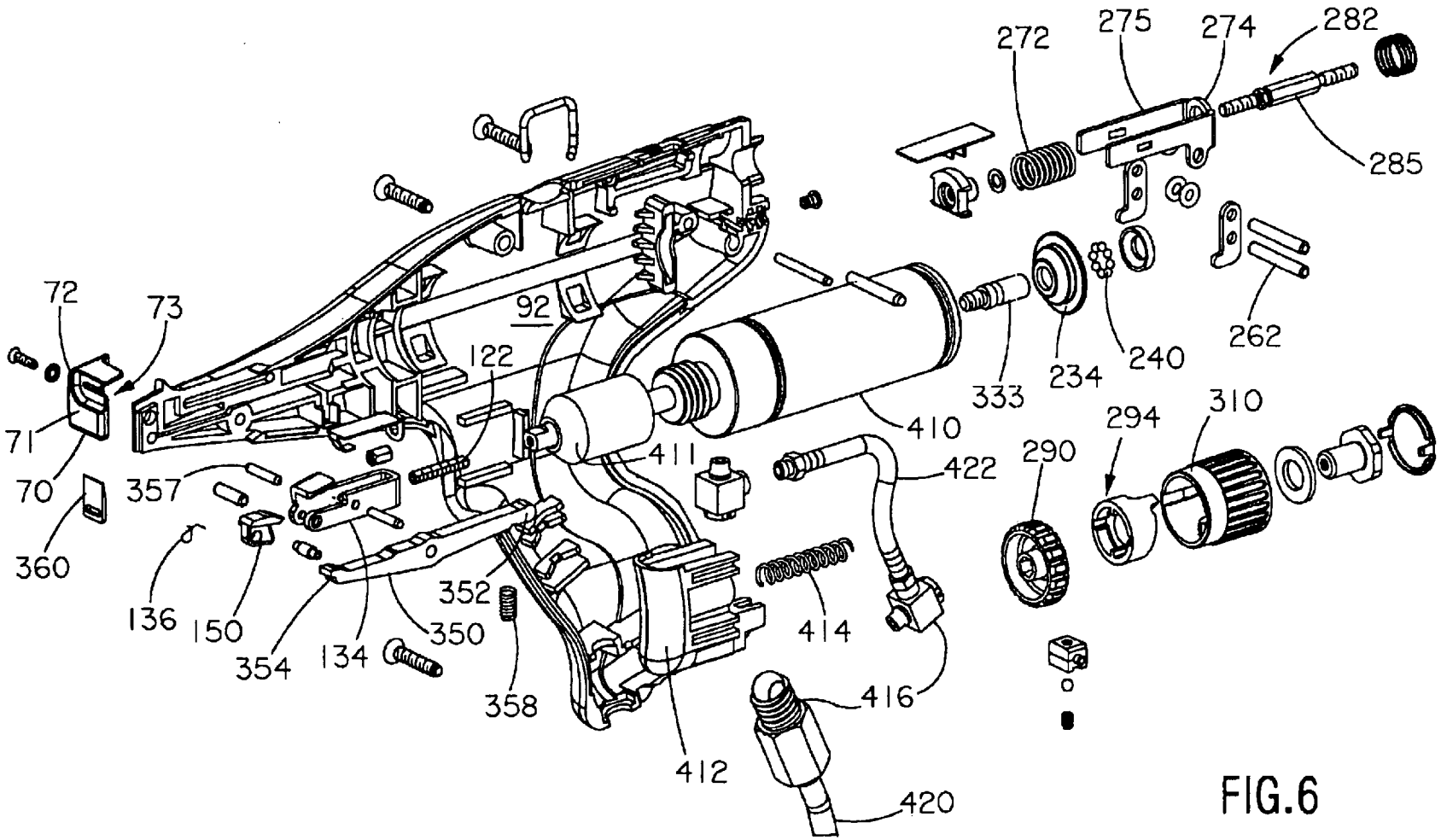
FIG. 6 is an exploded left side front upper perspective view of the tool of FIG. 1.

FIG. 7 shows a preferred embodiment of the cutting mechanism 330, some parts of which are more easily viewed in exploded FIG. 6. The cutting mechanism includes a lever arm 350, a spring 358, a severing blade 360, and a blade guard 70.

The ball detent assembly 232 supports, guides and controls movement of a detent sleeve 333 that is threadedly received into the proximate end of the single reverse acting cylinder. The detent housing 234 provides a bearing element at the distal or bottom of the cup for the smooth cylindrical portion of the proximate bearing surface. The ball bearings 240 of the ball detent assembly 232 are circumferentially forced into a groove and oppose the constant force applied by the reversing links and prevent actuation of the cutting mechanism 330 until the desired predetermined tension setting is achieved. Further discussion of this operation is included below.

The cutting mechanism lever arm 350 proximate end 352 has a generally arcuately or rounded shape protrusion formed thereon. Preferably, a slight amount of grease provided thereon will allow smooth pivotal actuation of the lever arm 350 by the conically shaped cam 411 at the distal end of the single reverse acting cylinder 410. As the force applied to the tension rod 122 readies the desired tension setting, the ball bearings 240 of the ball detent assembly 232 are forced radially outward away from the groove, pushing the seat proximately, thus overcoming the stored force in the tension adjustment assembly 270, the detent sleeve 332 may then be further urged distally and the proximate end 352 of the lever arm 350 will be forced toward the bottom 56 of the barrel 50. A laterally extending aperture is provided at a desired position in a central portion of the lever arm 350 for receiving a pivot pin 357 therethrough, the pin 357 being complementarily sized to engage a pin boss formed in each housing sidewall 90 and 92. The distal end 354 of the lever arm 350 includes a stepped or raised surface. The stepped surface engages a slot disposed on a lower end of the severing blade 360. The severing blade 360 remains in position, captured between the guide boss and the blade guard 70, during movement of the lever arm 350. The blade 360 cuts through a portion of the thickness of the cable tie tail 12, typically about ½ or ⅔ of the thickness, before returning toward its initial position—preferably the blade does not contact the anvil. The tension stored in the tie tail during the cutting step serves to propagate the cut and complete the severance of the tail 12 after the blade cuts through a portion thereof.

As shown in detail in the '053 patent, the depicted embodiment includes a means for visually indicating the tension level setting. A window is provided in the top raised surface of the tool housing 30 adjacent the tension adjustment assembly 270. Guide tracks are formed in the housing sidewalls 90 and 92 and support a display plate which is slidable in the tracks. The sliding display plate is preferably generally flat and has means for engaging the tension adjustment assembly in the form of a notch defined by a pair of parallel depending projections. The notch engages an upper extension of the tension nut and correspondingly moves therewith.

Also like the embodiment(s) shown described and shown in the '053 patent, the present tool further includes a retractable bail disposed to extend out of and retract into the bottom 40 of the handle portion 32.

In operation, as shown in FIGS. 7–8 and 14–17, a cable tie tail 12, after having been wrapped around a bundle of wires or cables 13 and inserted through the cable tie head 11, is inserted into the tie slot 73 with the tool 20 at its normal, initial at-rest position, with the tie head 11 positioned adjacent the tie slot 73, and received within the recessed portion 72 thereof. As the trigger 412 is depressed by the operator, the three-way pneumatic valve 416 is actuated to permit pneumatic pressure to be transmitted from the external pneumatic power supply into the reverse single acting cylinder 410 on the distal side of the piston 424. The pressure pushes the cylinder 410 proximately so that the gripper assembly 132 is camingly actuated by the cam 411 to grip the tail tie 12. As the gripper assembly 132 is drawn away from the guide boss, the pawl 150 is rotated counterclockwise by the gripper spring 136 to capture the tie tail 12 between the pawl 150 and the pressure plate.

Thus, as the tie is tensioned around the bundle, and pneumatic pressure simultaneously pushes the piston proximately, the tension rod 122 is placed in tension, which through the single reverse acting cylinder 411, and the integrally attached detent sleeve 333, applies a force to the force transfer assembly 250. The detent sleeve 333 is held stationary during tensioning by the restraining mechanism 230. The detent sleeve 333 remains stationary in its initial position with the ball bearings 240 engaging the groove and exerting a circumferential force thereon equal to the force stored in the tension adjustment assembly 270 as long as the force imparted to the detent sleeve 333 is less than the force stored in the tension adjustment assembly 270. When the desired predetermined tension setting is achieved in the cable tie 10 or, a more accurately when the force imparted to the sleeve 333 in the distal direction, exceeds the force stored in the tension adjustment assembly 270, the ball bearings 240 are forced out of the groove in the detent sleeve 333. The force stored in the tension adjustment assembly 270 is overcome when the ball bearings 240 are forced out of the groove and push the seat proximately back slightly, which causes the force transfer assembly 250 to temporarily further compress the tension spring 272. The detent sleeve 333, along with the rigidly attached reverse single acting cylinder, are thus thrust distally forward causing the cam 411 on the distal end thereof to impart a force on the lever arm 350. The lever arm pivots about its pivot pin 357, thereby raising the stepped surface and the severing blade 360 upwards to partially cut the cable tie 10. The tension stored in the tie propagates the partial cut to severance, and tool 20 resets to its normal initial position through the biasing action of the lever arm spring 358 and the return spring 426 within the cylinder 410.

While the preferred embodiments of the invention have been shown and described, it will be obvious to those skilled in the art that changes and modifications may be made therein without departing from the spirit of the invention, the scope of which is defined by the appended claims.

What is claimed is:

1. A tool for installing a cable tie, said cable tie having a head portion and an elongate tail portion extending therefrom, said tool comprising:

a housing having a distal end and a proximate end;

a tensioning mechanism for tensioning said cable tie to a predetermined tension setting, said tensioning mechanism operatively supported by said housing;

a cutting mechanism for severing an excess portion of said tail from said tensioned cable tie, said cutting mechanism operatively supported by said housing;

a power delivery system for actuating said tensioning and cutting mechanisms, said power delivery system for delivering power generally in line with said tensioning mechanism, said power delivery system is pneumatic; and a restraint mechanism for providing said predetermined tension setting wherein said restraint mechanism provides said predetermined tension generally in line with said tensioning mechanism and includes a ball detent assembly generally axially aligned with said tensioning mechanism.

2. A tool in accordance with claim 1 further including a tension adjustment assembly having one or more tension adjustment knobs.

3. A tool in accordance with claim 2 wherein said at least one tension adjustment knob is disposed near said proximate end of said housing.

4. A tool in accordance with claim 2 wherein said tension adjustment assembly includes at least one tension adjustment knob, a yoke, a shaft, a tension nut, a spring, and a cam.

5. A tool in accordance with claim 4 wherein said tension adjustment assembly includes both a coarse tension adjustment knob and a fine tension adjustment knob.

6. A tool in accordance with claim 2 wherein said tension adjustment assembly includes a tension setting indicator.

7. A tool in accordance with claim 1 wherein said power delivery system is actuable by depressing a trigger on said housing.

8. A tool in accordance with claim 7 wherein said trigger activates said pneumatic power delivery system via a three-way pneumatic valve.

9. A tool in accordance with claim 8 wherein said trigger activates said tensioning mechanism.

10. A tool in accordance with claim 9 wherein said trigger activates said tensioning mechanism to exert a circumferential force on said cutting mechanism, thereby preventing movement of said cutting mechanism prior to said cable tie tension reaching said predetermined tension setting, and simultaneously to increase tension in said cable tie until said predetermined tension setting is reached, whereby said predetermined tension setting being reached activates said cutting mechanism.

11. A tool for installing a cable tie, said cable tie having a head portion and an elongate tail portion extending therefrom, said tool comprising:

a housing;

a tensioning mechanism for tensioning said cable tie to a predetermined tension setting, said tensioning mechanism operatively supported by said housing, said tensioning mechanism including a linearly reciprocating tension rod and a reverse single acting cylinder;

a cutting mechanism for severing an excess portion of said tail from said tensioned cable tie, said cutting mechanism operatively supported by said housing;

a restraining mechanism including a ball detent assembly, said restraining mechanism being in communication with said reverse single acting cylinder and being generally axially aligned with said linearly reciprocating tension rod and said reverse single acting cylinder, said restraining mechanism for effecting a predetermined tension setting on said reverse single acting cylinder; and a manually actuable external power delivery system for actuating said tensioning and cutting mechanisms, said power delivery system including a pneumatic power source, a trigger, and a three-way pneumatic valve;

whereby when said trigger is manually actuated, pneumatic pressure forces said reverse single acting cylinder to rearwardly pull said linerly reciprocating tension rod, thereby simultaneously restraining movement of said cutting mechanism and tensioning said cable tie until said predetermined tension setting effected by said restraining mechanism is reached in said cable tie, after which said reverse single acting cylinder is released from said pneumatic pressure such that said reverse single acting cylinder is thrust forwardly to activate said cutting mechanism to sever said cable tie.

12. A tool in accordance with claim 11 wherein said tension adjustment assembly includes one or more tension adjustment knobs.

13. A tool in accordance with claim 12 wherein said at least one tension adjustment knob is disposed proximate the rear end of said housing.

14. A tool in accordance with claim 12 wherein said tension adjustment assembly further includes a yoke, a shaft, a tension nut, a spring, a fine tension adjustment knob, a cam, and a coarse tension adjustment knob.

15. A tool in accordance with claim 12 wherein said tension adjustment assembly includes a tension setting indicator.

16. A tool in accordance with claim 11 wherein said restraining mechanism is generally aligned with said tensioning mechanism.

* * * * *

UNITED STATES PATENT AND TRADEMARK OFFICE

CERTIFICATE OF CORRECTION

PATENT NO. : 6,840,289 B2
DATED : January 11, 2005
INVENTOR(S) : Lawrence A. Hillegonds It is certified that error appears in the above-identified patent and that said Letters Patent is hereby corrected as shown below:

Column 10,
Line 44, the word “a” should be omitted after “or.”.

Column 12,
Line 28, “linerly” should read -- linearly --.

Signed and Sealed this

Sixth Day of September, 2005

JON W. DUDAS
*Director of the United States Patent and Trademark Office*